United States Patent [19]

Homma et al.

[11] Patent Number: 4,958,589

[45] Date of Patent: Sep. 25, 1990

[54] CONTINUOUS MELT-PLATING APPARATUS

[75] Inventors: Masatoshi Homma; Teruo Yamaguchi, both of Hitachi; Tuneyuki Hasegawa, Hiratsuka, all of Japan

[73] Assignee: Hitachi, Ltd., Tokyo, Japan

[21] Appl. No.: 329,821

[22] Filed: Mar. 28, 1989

[30] Foreign Application Priority Data

Mar. 30, 1988 [JP] Japan ..... 63-74361

[51] Int. Cl.[5] ..... B05C 3/12

[52] U.S. Cl. ..... 118/672; 118/677; 118/63; 118/419; 118/423; 118/428

[58] Field of Search ..... 118/63, 55, 419, 672, 118/677, 423, 424, 428; 226/174, 175, 179, 180, 15.21, 168, 2; 242/76

[56] References Cited

U.S. PATENT DOCUMENTS

| | | | |
|---|---|---|---|
| 1,528,407 | 3/1925 | Davis | 118/419 |
| 2,824,020 | 2/1958 | Cook et al. | 118/419 |
| 2,970,339 | 2/1981 | Hausman | 29/113.2 |
| 3,726,588 | 4/1973 | Moser | 226/15 |
| 3,831,828 | 8/1974 | Royon et al. | 226/191 |
| 4,082,868 | 4/1978 | Schnedler et al. | 118/419 |
| 4,464,921 | 8/1984 | Surat | 29/113.1 |
| 4,583,273 | 4/1986 | Schnyder et al. | 29/113.2 |

FOREIGN PATENT DOCUMENTS

| | | |
|---|---|---|
| 0188813 | 1/1986 | European Pat. Off. . |
| 3210288 | 6/1983 | Fed. Rep. of Germany . |
| 2337205 | 7/1977 | France . |
| 45-41085 | 12/1970 | Japan . |
| 54-18430 | 2/1979 | Japan . |
| 55-34609 | 5/1980 | Japan . |
| 61-147900 | 7/1986 | Japan . |
| 62-30865 | 7/1987 | Japan . |

*Primary Examiner*—Willard Hoag

*Attorney, Agent, or Firm*—Fay, Sharpe, Beall, Fagan, Minnich & McKee

[57] ABSTRACT

A continuous melt-plating apparatus has a guide roller provided above the sink roller. The guide roller is capable of curving into a configuration arbitrarily varied in the widthwise direction of the strip, in such a manner that the waving and curving of the steel strip, which is very variable depending on the thickness, the width and the material of the steel strip, changes of the sink roller, the plating speed, and the thickness of the plating, can be coped with precisely in accordance therewith. A detector for detecting the degree of flatness of the steel strip in the widthwise direction is provided downstream of the gas wiping nozzle, and the curving of the guide roller is controlled through a feedback control for adjusting the amount of variation of the guide roller's pushing, so that the flatness can be precisely maintained right at the portion corresponding to the gas wiping nozzles. By virtue of this arrangement, it is possible to achieve flatness of the steel strip with a high degree of precision in the portion corresponding to the gas wiping nozzle. Therefore, the gap between the gas wiping nozzle and the steel strip can be maintained constant widthwise, thereby making constant the force from the nozzle with which excess of the plating melt is blown off and wiped off, which in turn makes it possible to obtain platings of very uniform thickness.

8 Claims, 5 Drawing Sheets

CONTINUOUS MELT-PLATING APPARATUS

BACKGROUND OF THE INVENTION

1. Field of the Invention

The present invention relates to a continuous melt-plating apparatus and, more particularly, to a continuous melt-plating apparatus suitable for adjusting the flatness of a gas wiping portion of a steel strip subjected to a continuous melt-plating method in which gas wiping is effected.

2. Description of the Prior Art

Conventional continuous melt-plating methods include: a type of method in which the steel strip is not subjected to acid cleaning or flux treatment, but is surface cleaned by performing oxidation and reduction before plating; and another type in which acid cleaning and flux treatment are performed before plating. An example of a method of the former type is disclosed in Japanese Patent Unexamined Publication No. 61-147900.

In a continuous melt-plating apparatus for carrying out such a continuous melt-plating method, an arrangement for maintaining the flatness of the steel strip in the gas wiping portion is disclosed in, for instance, Japanese Patent Publication No. 45-41085. In this arrangement, two guide rollers are provided between the gas wiping nozzle and a sink roller disposed below the nozzle, with one of the guide rollers being positioned lower than the other. The lower guide roller is adjusted in such a manner as to be offset from the mating guide roller, so that widthwise curving resulting from the rising of the steel strip can be corrected in order to maintain the flatness of the steel strip right at the portion opposing the gas wiping nozzle.

Gas wiping has been developed for use in plating a steel strip with a melt such as zinc, aluminum and nickel, and since it has various advantageous features, gas wiping is at present adopted in almost all the plating methods in this field. When gas wiping is to be effected with a view of blowing off and wiping off an excess of the plated melt layer, it is important to give consideration to the fact that the amount by which the melt can be blown and wiped off is greatly varied depending on the gap between the nozzle and the steel strip (i.e., the gap between the gas injection port and the steel strip). Certain experiments have shown that the resultant thickness $\Delta t$ of a plating is expressed by the following formula:

$\Delta t \propto C \cdot \sqrt{\delta}$ where $\Delta t$: thickness of plating $\delta$: gap between the tip of the nozzle and the steel strip C: constant Therefore, if the gas wiping portion of a steel strip has any irregularities occurring in the widthwise direction thereof, the irregularities cause corresponding variations in the gap between the steel strip and the nozzle and, hence, variations in the thickness of the plated layer. When the thickness of a plating is to be set, because the thickness of the thinnest portion has to be used as the reference from the viewpoint of assuring the performance of the plating, the thickness is inevitably set to a rather large value capable of compensating for those possible variations in the thickness of the plating. Thus, the thickness of a plated layer includes a margin corresponding to variations therein, which is termed a dead thickness. The thickness of the plating is also affected by the waving and curving of a portion of the steel strip which moves above the nozzle. In particular, when the steel strip has a relatively small thickness, curving occurs severely. Since a portion of the steel strip which has left the plating path cannot be held by, e.g., rollers until it is cool, the portion gradually curves in the widthwise direction after leaving the roller in the plating bath because of widthwise difference in thermal expansion resulting from changes in temperature generated during the plating. In order to compensate for the widthwise difference in expansion and also to center the steel strip, a crown is often provided for the sink roller within the plating bath. However, such a crown itself often causes the curving and waving of the steel strip. A high degree of curving amounts to about ±20 mm. Since the gap between the nozzle and the steel strip generally averages about 30 to 50 mm, there is a risk of large variations being caused in the thickness of the plated layer.

Curving leads to the following problem as well. When the plated melt layer and the nozzle opening are brought into mutual contact by attracting action between the tip of the nozzle and the curved steel strip, part of melt in the plated layer adheres to the nozzle opening, resulting in clogging or other disadvantages.

In order to overcome these problems, Japanese Patent Publication No. 45-41085 proposes a solution in which curving is corrected by means of the offset between or the overlap of the two guide rollers provided between the sink roller and the gas wiping nozzle. According to this proposal, however, since the curving of the steel strip is corrected solely by the overlap of straight rollers, the amount and the configurations provided by this correction are inevitably limited. Thus, the proposal has not been able to correct very large curving or complicated waving. Also, the degree of precision with which the gas wiping portion is kept flat has not been sufficient. Hitherto, because the plating speed (i.e., the speed at which the steel strip is passed) has been relatively low (i.e., approximately 50 to 100 m/min at most), the proportion in which the gap between the nozzle tip and the steel strip is varied has not been very large even if the gap is relatively large and the precision of the flatness is poor. It has therefore been possible to achieve thickness of platings which is uniform to a substantially satisfactory degree. In the case of the above-described prior art, although the correcting ability of the guide rollers is limited and, in addition, the difference in height between the guide rollers and the gas wiping nozzle is restricted to 300 mm or below, no problem has been encountered in practice.

Although gas wiping was at first used in the molten-zinc plating lines, as the application of gas wiping broadens during the passage of a long period into almost all the platings of Zn, Al, Ni, etc., an increasingly higher level of performance has been required. Currently, it is clearly seen that there are strong demands for, e.g., the achievement of plating thickness which is uniform to a higher degree with a view to saving resources and reducing the unit, and for the enhancement of the plating speed and, hence, the production efficiency. In order to enhance the plating speed (i.e., the steel strip passing speed) with the same thickness of the plating, it is necessary either to bring the tip of the gas wiping nozzle closer to the steel strip or to increase the gas discharge pressure. Since an increase in the gas pressure leads to an increase in the unit, and also leads to an increase in the noise generated in the vicinity of the plating bath and, hence, to deterioration in the working environment, the present situation is such that, on the contrary, the gas pressure is gradually lowered. For these reasons, in order to achieve thin platings at high speed, the gap between the tip of the nozzle and the steel strip must be much smaller than that conventionally provided. When the steel strip passing speed is increased, this causes an increase in the amount by which plating melt material (e.g., melt zinc) in the plating bath is attached to and thus raised by the steel strip. Therefore, it is necessary to increase the height of the gas wiping nozzle from the plating bath, and allow the excess of the plated layer to quickly drop off by its own weight, for the purpose of making it easy for blowing and wiping by gas wiping to achieve a thin thickness and for preventing the plating melt from scattering toward the nozzle and, hence, from causing clogging.

In the case where a sink roller is combined with a bearing portion disposed below the surface of the melt in the bath, plain bearings are in general used to form the bearing structure, as disclosed in Japanese Patent Unexamined Publication No. 54-18430. However, since the bearing surfaces are subjected to severe corrosion by the molten zinc, wear occurs in a short period. This has led to a loose fitting, with which the sink roller greatly vibrates in the transverse direction, resulting in great variations in the gap between the tip of the gas wiping nozzle and the steel strip and, hence, variations in the thickness of the plating. In order to avoid this risk, an arrangement is adopted in which the bearing portion is disposed above the upper surface of the bath melt.

In this way, in compliance with the demand for a drastic reduction in the gap between the tip of the nozzle and the steel strip, a higher degree of precision is achieved for the flatness of the gas wiping portion of the steel strip in the widthwise direction thereof.

SUMMARY OF THE INVENTION

The present invention has been made in view of the above-stated points. An object of the present invention is to provide a continuous melt-plating apparatus which is capable of maintaining a constant gap between the gas wiping nozzle and the steel strip in the widthwise direction of the strip, thereby achieving constant force with which the excess of plating melt is blown off and wiped off by the operation of the nozzle, and which is thus capable of providing platings of very uniform thickness.

In order to achieve the above-stated object, according to the present invention, a guide roller provided above the sink roller is capable of curving into a configuration arbitrarily varied in the widthwise direction of the steel strip, in such a manner that the waving and curving of the steel strip, which is very variable depending on the thickness, the width and the material of the steel strip, aging changes of the sink roller, the plating speed, and the thickness of the plating, can be coped with precisely in accordance therewith. Specifically, in order to maintain the flatness of the steel strip right at the position of the gas wiping nozzle, the pushing of the roller is provided with an arbitrary variation such as a crown-type variation in which the widthwise center of the steel strip is pushed slightly beyond the pass line of the steel strip flowing from the sink roller while the widthwise ends of the strip are kept free, or a taper-type variation in which the pushing linearly is varied widthwise from one widthwise end. According to the present invention, in order to further enhance the degree of reliability of the precision, a detector for detecting the degree of flatness of the steel strip in the widthwise direction thereof is provided downstream of the gas wiping nozzle, and feedback control is performed for adjusting the amount of variation of the guide roller's pushing, so that the flatness can be precisely maintained right at the portion corresponding to the gas wiping nozzle. Further, the steel strip cannot be held by means of rollers after it has left the plating bath until the plated melt layers cool down to solidify, during which time it travels several tens of meters. This might lead to the risk of the gap between the tip of the nozzle and the steel strip being varied by vibration of the strip which is enlarged from the vibration at the vibration source such as the sink roller. In order to avoid this risk, the bearings for the sink roller and the guide roller are disposed outside the melt in the bath, thus providing bearings with a high degree of precision. This contributes to a further increase in the precision with which the flatness of the strip is maintained.

Thus, according to the present invention, the guide roller is capable of applying a pushing, with the pushing amount being varied in the widthwise direction of the steel strip; or widthwise bending, and even waving and inclination, are caused in the guide roller per se. Feedback control is performed for adjusting the amount of variation of the guide roller's pushing. By virtue of this arrangement, it is possible to eliminate bowing, waving or the like of the steel strip in the widthwise direction thereof. Accordingly, the gap between the gas wiping nozzle and the steel strip can be maintained substantially constant in the widthwise direction, so as to achieve the above-stated object.

DETAILED DESCRIPTION OF THE PREFERRED EMBODIMENTS

Figure 1:
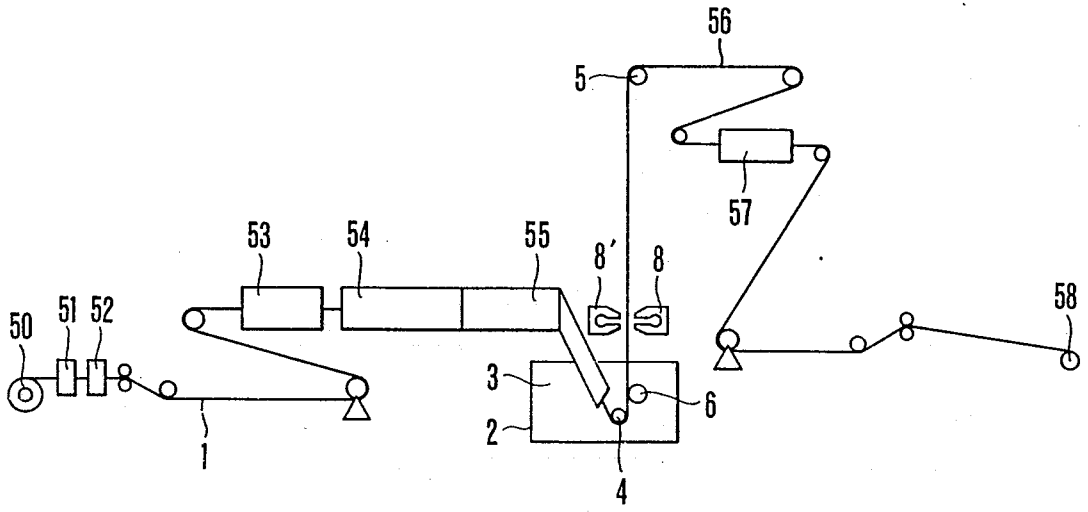
FIG. 1 is a view schematically showing the overall structure of one embodiment of the continuous melt-plating apparatus of the present invention.

The present invention will be described hereunder in detail with respect to embodiments thereof shown in the drawings.

FIG. 1 shows the overall structure of one embodiment of the continuous melt-plating apparatus of the present invention. The apparatus is of the type in which the surfaces of a steel strip 1 are cleaned by oxidation and reduction before plating. A steel strip 1 is continuously fed from a coil 50 through a cutting shear 51 and a welder 52 to an oxidation furnace, 53 and a reduction furnace comprising 20 a reduction zone 54 and a cooling zone 55, in these furnaces the steel strip 1 is subjected to pretreatment for plating. The steel strip 1 is fed to a plating bath 2 and is then passed therethrough. Provided in combination with the plating bath 2 are a sink roller 4, a guide roller 6, and gas wiping nozzles 8 and 8' for attaining a necessary plating thickness of molten zinc 3 attached to the steel strip 1. These members will be described later in detail. The plated steel strip 1 is fed through a deflecting roller 5 to pass through a cooling zone 56, then passes through a chromate treatment layer 57, etc., is subjected to final treatment, and is finally wound on a winding reel 58.

Figure 2:
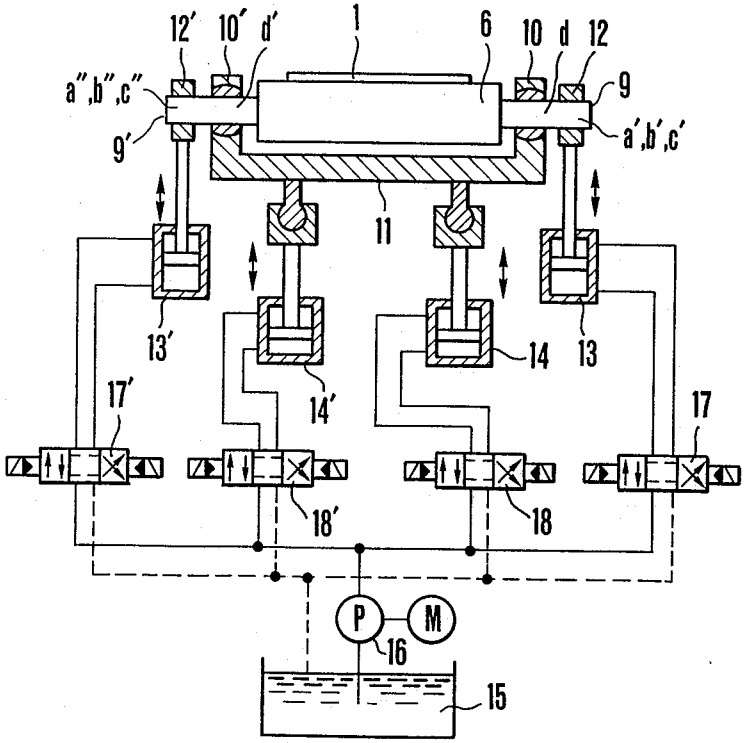
FIG. 2 is a view showing a part of the apparatus shown in FIG. 1 which includes a guide roller used in the apparatus.

Referring to FIG. 2, the steel strip 1, which has a thickness of 0.2 to 3.2 mm and may be used mainly as steel plates for motor vehicles, has been heated in the upstream furnaces 53 and 54, and is kept in a condition enabling suitable formation of alloy layers without causing rapid solidification of the plated melt layers. While the steel strip 1 is kept in a reduction atmosphere, it is passed through molten zinc 3 in the plating bath 2. (The molten zinc 3 is provided for a continuous moltenzinc plating, a typical example to which the present invention may be applied; the following description will be given concerning this example). The sink roller 4 holds in position a plating bath portion of the steel strip 1 and also a portion between the sink roller 4 and the deflecting roller 5. The guide roller 6 is provided immediately downstream of the sink roller 4. A portion of the steel strip 1 which has left the plating bath 2 carries excess molten zinc 7 attached thereto. This excess molten zinc 7 is blown off and wiped off by high-temperature and high-pressure gas injected from the gas wiping nozzles 8 and 8', thereby attaining the necessary thickness of the plated layer. The distance from the gas wiping nozzles 8 and 8' to the deflecting roller 5 is about 40 m. While the steel strip 1 portion ascends through this distance, the solidification and cooling of the plated layers proceed, so that when the portion has reached the deflecting roller 5, it is cool at a suitable temperature. Thereafter, the portion passes through a cooling device, not shown, in the cooling zone 56 and is thus cooled down to normal temperature. Finally, the steel strip portion is fed to a winder where it is formed into a coil.

Figure 3:
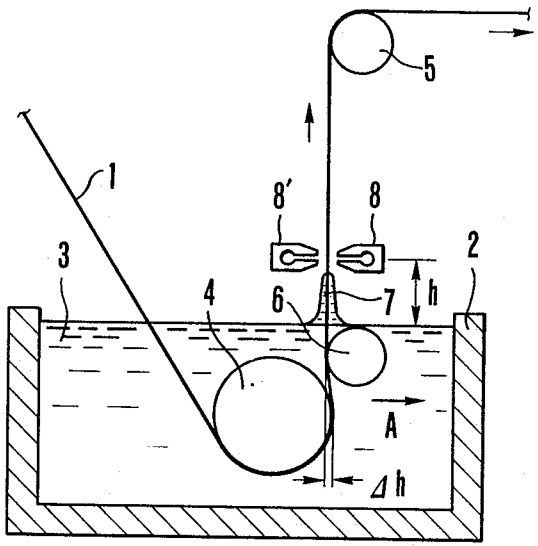
FIG. 3 is a view schematically showing essential parts of the apparatus shown in FIG. 1.

FIG. 2 is a plan view of the guide roller 6 shown in FIG. 3, taken from above and showing the condition in which the steel strip 1 is in contact with the guide roller 6. Two ends 9 and 9' of a shaft through the guide roller 6 are supported by spherical bearings 10 and 10' provided in a frame 11, and also by bearings 12 and 12'. The bearings 12 and 12', and the frame 11 operate in the directions indicated by the arrows shown in FIG. 2 by the action of hydraulic cylinders 13 and 13', and 14 and 14', respectively. Hydraulic pressure is delivered from a supply tank 15 by a pump 16, and is supplied through electromagnetic changeover valves 17 and 17', and 18 and 18' in accordance with the direction of operation of the corresponding hydraulic cylinders.

Figure 4:
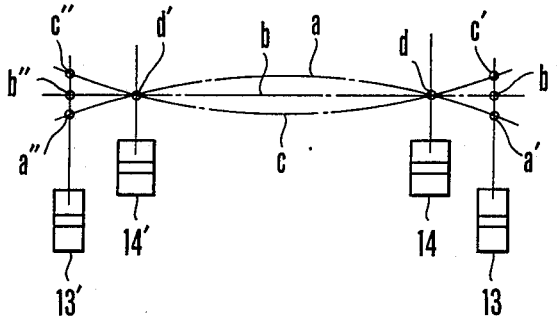
FIG. 4 is a schematic illustration of the behavior of the guide roller in the embodiment.

FIG. 4 shows the behavior of the guide roller 6 which is obtainable by the action of the hydraulic cylinders 13, 13', 14 and 14'. When the hydraulic cylinders 13 and 13' are operationally advanced, with the centers d and d' of the spherical bearings 10 and 10' being fixed by holding the hydraulic cylinders 14 and 14' at their operational intermediate positions, the guide roller 6 and the shaft 9 - 9' become curved in a concaved manner along the line c'' - c - c' (shown in FIG. 4), about the centers d and d'. Conversely, when the hydraulic cylinders 13 and 13' are operationally retracted while the hydraulic cylinders 14 and 14' remain the same, the guide roller and the shaft become curved in a convex manner along the line a'' - a - a', about the centers d and d'. When the hydraulic cylinders 13 and 13' are brought to their central positions while the hydraulic cylinders 14 and 14' remain the same, the guide roller becomes flat together with the shaft along the line b'' - b - b'. When the hydraulic cylinder 13' is operationally advanced and the hydraulic cylinder 13 is operationally retracted, with the hydraulic cylinders 14 and 14' remaining the same, curves occur at c'' - d' and d - a', with the intermediate portion d' - d of the guide roller 6 being curved along a complicated curve. If, for instance, the hydraulic cylinder 14' is operationally advanced and the hydraulic cylinder 14 is operationally retracted, the frame 11 becomes inclined toward the right-lower side, as viewed in FIGS. 2 and 4. In this case, therefore, the axes of the various curves shown in FIG. 4 each becomes inclined toward the right-lower side. Needless to say, the reverse operation is also possible.

In this way, the shaft 9 - 9' of the guide roller 6 can be curved to provide the roller surface with a convex, concave, waving, or inclined configuration, so as to cope with the curved condition of the steel strip 1. However, an alternative arrangement may be adopted in which the roller surface of the guide roller 6 per se is formed with a convex, concave, waving, or inclined configuration in accordance with the curved condition of the strip 1.

As described above, the guide roller 6 is capable of imparting to the steel strip 1 a curve in the direction of the arrow A shown in FIG. 3, the curve being arbitrarily varied in the widthwise direction of the strip 1. Specifically, if a pushing amount $\Delta h$ beyond the pass line of the steel strip 1 is provided between the sink roller 4 and the guide roller 6, and if a curve arbitrarily varied in the widthwise direction is imparted to the steel strip 1 by the guide roller 6, it is possible to make the steel strip 1 flat in the widthwise direction thereof at the position of the gas wiping nozzles 8 and 8'.

Figure 5:
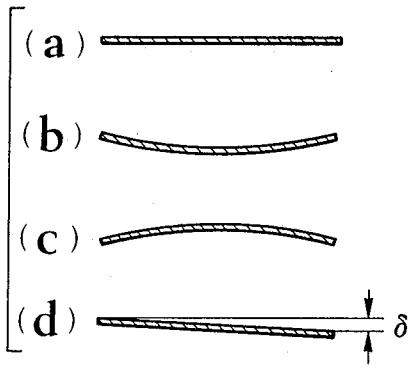
FIGS. 5(a) to (d) are views showing various configurations of a steel strip.

While the steel strip 1 travels from the sink roller 4 to the deflecting roller 5, it actually assumes various widthwise configurations, such as those shown in FIGS. 5. It is desired that the configuration at the height of the gas wiping nozzle should be flat, as shown in FIG. 5(a), in other words, it should be such that the distance between the tip of the nozzle and the steel strip 1 is constant in the widthwise direction of the strip, so that the thickness of the plating will be uniform in the widthwise direction. From the viewpoint of maintaining the surface configuration, the distance from the sink roller 4 to the deflecting roller 5 is too long for the travel of the steel strip 1 which must be kept contact-free until the plated layers solidify. Accordingly, at the position of the gas wiping nozzles 8 and 8' located midway between the rollers 4 and 5, since the steel strip 1 has a high degree of freedom, it assumes configurations such as those shown in FIGS. 5 or more complicated configurations, depending on such factors as the hysteresis resulting from the rolling in a previous process, the tensile force, the crown configuration of the sink roller 4. In practice, correction is performed in such a manner that waving, curving, or inclination which is approximately reverse to the sectional configuration of the sink roller 4 is imparted by the guide roller 6.

If the plating speed (the steel strip line speed) is increased in view of enhancing the productivity, splashes of excess molten zinc 7 being raised from the plating bath 2 tend to adhere to the tip of the nozzles. This tendency is strong particularly when the plating speed is beyond a speed of about 130 m/min. Also, the amount of adhering zinc 7 increases. By these reasons, the height h of the nozzles must be greater than the conventionally used value of about 300 mm, and should be 500 to 800 mm. With this arrangement, however, since the correction curve or the like imparted by the guide roller 6 must be greater, the problem cannot be coped with by adopting the conventional adjustment of the pushing amount Δh alone. Thus, the degree of flatness of the steel strip 1 at the nozzle portion can be maintained only if the arrangement of the present invention is adopted.

Figure 6:
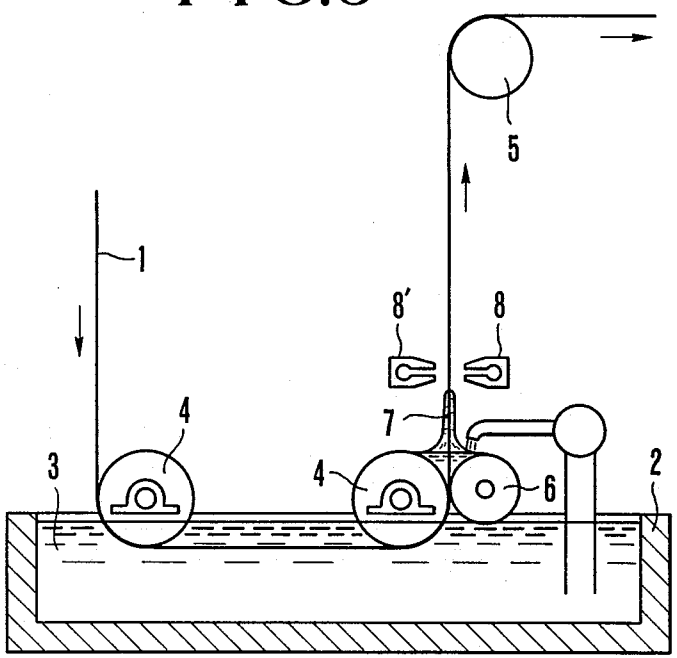
FIG. 6 is a view schematically showing another embodiment of the apparatus of the present invention.

FIG. 6 shows another embodiment. Two sink rollers 4 are provided and the shafts of the sink rollers are supported by bearings on the outside of the plating bath melt 3, and a guide roller 6 is also supported on the outside of the plating bath melt 3. In this embodiment, since the portion of contact between the sink roller 4 and the guide roller 6 is located outside of the bath melt 3, molten zinc forming the plating bath melt 3 is supplied by a pump to a position above the contact portion, thereby facilitating the attachment of molten zinc to the surfaces of the steel strip 1.

Figure 7:
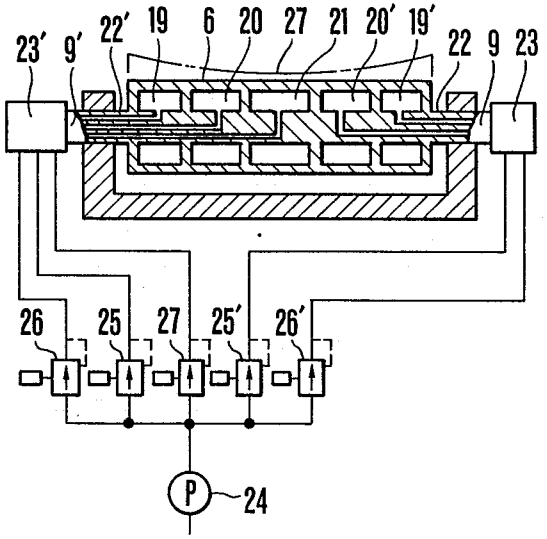
FIG. 7 is a sectional view showing a modification of the guide roller.

FIG. 7 shows a modification of the guide roller 6 shown in FIG. 1. The inside of the guide roller 6 is divided into small chambers denoted at 19, 19', 20, 20' and 21. Each of these small chambers is capable of expanding by hydraulic pressure delivered from a pump 24 through holes such as those denoted at 22 and 22', and through rotary couplings 23 and 23'. The pressure within the chambers are varied by means of pressure reducing values 25, 25', 26, 26' and 27, thereby adjusting the amount of expansion. For instance, when the pressure within the central chamber 21 is made relatively low while those of the chambers 20 and 20' are made slightly higher and those of the chambers 19 and 19' are made much higher, a curve 27, such as that denoted by the two-dot-chain lines in FIG. 7, can be achieved. If the pressure of the pressure reducing valves 25, 25', 26, 26' and 27 is varied, it is possible to achieve, not only the curves shown in FIG. 4, but also any arbitrary curves and inclinations varied in a more complicated manner. Although the number of the small chambers shown in FIG. 7 is five, if this number is increased, the degree of precision is further enhanced as compared to the embodiment shown in FIG. 1. In addition, waves can be set in a more linear manner and, hence, more easily.

Figure 8:
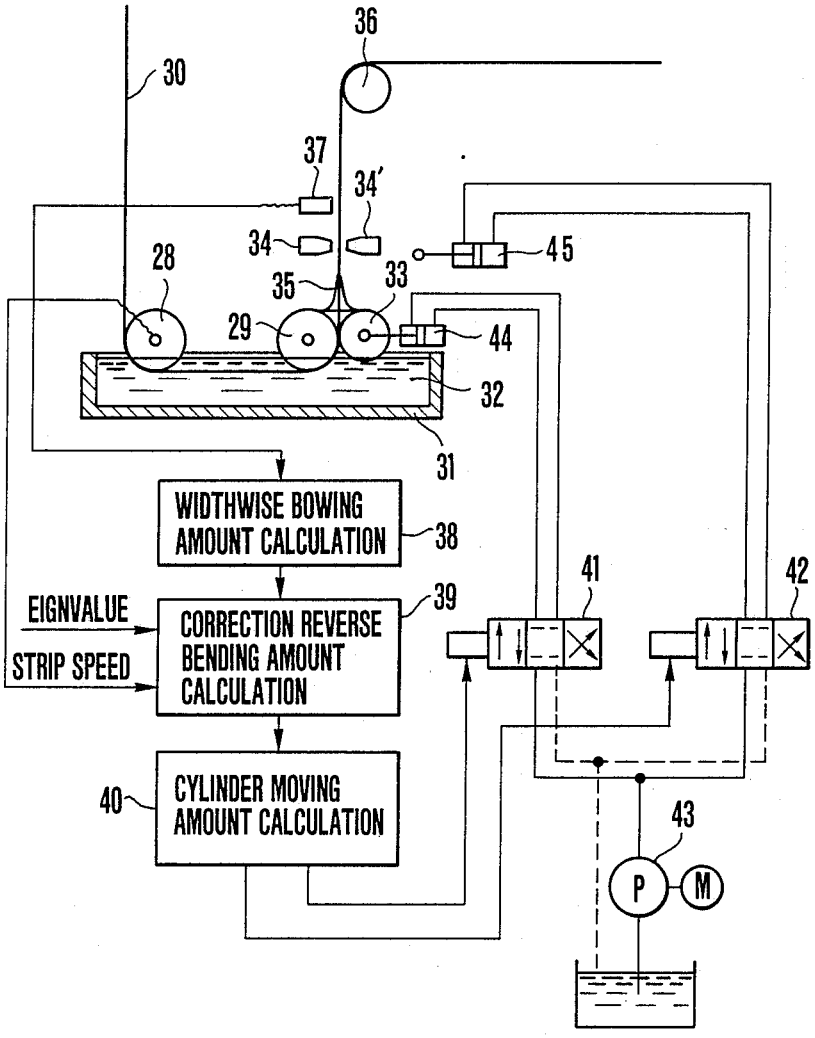
FIG. 8 is a view schematically showing the overall structure including a control system of the embodiment shown in FIG. 6.

Referring to FIG. 8, a steel strip 30 is fed from a furnace having a reduction atmosphere, and is held by sink rollers 28 and 29 while it is passed through, e.g., a molten zinc 32 within the plating bath 31 for a certain period. Similarly to the embodiment shown in FIG. 1, a guide roller 33 imparts to the steel strip 30, a waving or bowing correction in the widthwise direction. Gas wiping nozzles 34 and 34' blow off and wipe off excess molten zinc 35 attached to and raised by the steel strip 30, so as to achieve an appropriate thickness. The strip 30 further moves upward while it cools, to reach a deflecting roller 36. The bearing portions of the sink rollers 28 and 29 and the guide roller 33 are positioned higher than the upper surface of the plating bath melt 32. In contrast to the arrangement of the sink roller 4 shown in FIG. 3, if the arrangement shown in FIG. 8 is adopted, in which the bearing portions are positioned above the upper surface of the plating bath melt, it is possible to use bearings such as ball-and-roller bearings. Because such bearings involve smaller gaps than plain bearings and only a very low degree of wear, it is possible to ensure that there is substantially no loose fitting.

A plurality of range finders 37 are provided close to the steel strip 30 and arranged in the widthwise direction. These range finders 37 momentarily measure changes in the gap between the steel strip 30 and the range finders 37 resulting from the bowing and waving of the steel strip 30 in the widthwise direction. A widthwise bowing computing element 38 performs calculations on the result of this measurement. A tachometer (not shown) is mounted on the shaft of the sink roller 28, for measuring the number of revolutions of the sink roller 28. The measured value is sent to a correction bending amount computing element 39. In the element 39, the value is referred to together with the calculated current amount of the widthwise bowing and the machine eigenvalues, and the amount of waving, widthwise bending, and inclination which should be imparted by the guide roller 33 to the steel strip 30 is calculated, so that the steel strip 30 will be flat in the widthwise direction right at the position of the nozzles 34 and 34'. On the basis of a command indicating the result of this calculation, another computing element 40 calculates a necessary cylinder moving amount, and on the basis of this amount, electromagnetic valves 41 and 42 are operated for a predetermined period so as to operate hydraulic cylinders 44 and 45 in a necessary direction by a necessary amount of operation. Although two hydraulic cylinders are shown in FIG. 8, four hydraulic cylinders may be alternatively provided, as shown in FIG. 2. A further alternative arrangement may be adopted in which a roller has a plurality of small chambers, and electromagnetic hydraulic pressure reducing valves, such as the electromagnetic hydraulic pressure changeover valves shown in FIG. 7, are provided for varying the pressure within the small chambers, so as to effect necessary control.

With the above-described arrangement, since the bearing portions of the sink rollers 28 and 29 are free from loose fitting, it is possible to hold the steel strip 30 in its constant position. This advantage, together with the advantage in which the widthwise bowing and waving of the steel strip is eliminated, enables maintenance of a substantially constant the widthwise gap between the gas wiping nozzle 34 and 34' and the steel strip 30. Accordingly, the force from the nozzles with which the excess molten zinc 35 is blown off and wiped off can be kept constant, and, in this way, plating layers having very uniform thickness can be attained.

Although the above description concerned an example in which the surfaces of the steel strip 1 are cleaned by oxidation and reduction before plating, the continuous melt-plating apparatus of the present invention may also be applied in a similar manner to the case where acid cleaning and flux treatment are performed before plating.

As has been described, with the continuous melt-plating apparatus of the present invention, since the widthwise gap between the gas wiping nozzle and the steel strip can be maintained constant, it is possible to obtain plating layers having very uniform thickness.

What is claimed is:

1. A continuous melt-plating apparatus having:

a plating melt bath, a sink roller disposed in the plating melt of said plating melt bath for conveying a steel strip wound thereon and serving as a material to be plated, gas wiping nozzles located above said plating melt bath and respectively disposed adjacent to a front surface and a rear surface of said steel strip so as to blow off and wipe off part of the plating melt attached to the front surface and rear surface of said steel strip to adjust the plating thereon to a desired thickness the continuous melt-plating apparatus comprising:

a guide roller having at least a part thereof immersed in said plating melt bath, and disposed on the opposite side of said steel strip from said sink roller, between said nozzle and said sink roller, and adjustment means for bending said guide roller in the widthwise direction thereof so as to be capable of pushing said steel strip with a force varied in the widthwise direction of said steel strip.

2. A continuous melt-plating apparatus according to claim 1, said adjustment means further including means for inclining an axis of said guide roller in the horizontal direction thereof.

3. A continuous melt-plating apparatus having a plating melt bath, a sink roller disposed in said plating melt bath and capable of conveying a steel strip wound thereon and serving as a material to be plated, and a gas wiping nozzle capable of blowing off and wiping off part of plating melt attached to a portion of said steel strip which is above and close to said plating melt bath, the continuous melt-plating apparatus comprising a guide roller provided at a position which is above said sink roller and below said gas wiping nozzle, said guide roller being provided with a roller bearing portion moving device for causing the inclination of said guide roller in the widthwise direction thereof, and a roller shaft pushing device for causing the bending and waving of said guide roller in the widthwise direction thereof.

4. A continuous melt-plating apparatus having a plating melt bath, a sink roller disposed in said plating melt bath and capable of conveying a steel strip wound thereon and serving as a material to be plated, and a gas wiping nozzle capable of blowing off and wiping off part of plating melt attached to a portion of said steel strip which is above and close to said plating melt bath, the continuous melt-plating apparatus comprising a guide roller provided at a position which is above said sink roller and below said gas wiping nozzle, said guide roller having a plurality of hydraulic pressure chambers arranged in the widthwise direction thereof, the pressure within each of said chambers being independently controlled and varied in such a manner as to cause the bending, waving, and inclination of said guide roller.

5. A continuous melt-plating apparatus according to claim 5, further comprising a roller bearing portion moving device for causing the inclination of said guide roller in the widthwise direction thereof.

6. A continuous melt-plating apparatus having:

a plating melt bath, a first sink roller disposed so as to immerse a part thereof in the plating melt of said plating melt bath for conveying a steel strip wound thereon and serving as a material to be plated, gas wiping nozzles located above said plating melt bath and respectively disposed adjacent to a front surface and a rear surface of said steel strip so as to blow off and wipe off part of the plating melt attached to the front surface and rear surface of said steel strip guided from said plating melt bath and to adjust the plating thereon to a desired thickness thereof, the continuous melt-plating apparatus comprising:

a second sink roller, a plurality of bearings for rotatably supporting each of said sink rollers and disposed above the plating melt surface of said plating melt bath, and said guide roller having at least a part thereof immersed in said plating melt bath, and being disposed on the opposite side of said steel strip from said first sink roller, and adjustment means for bending said guide roller in the widthwise direction thereof so as to be capable of pushing said steel strip with a force varied in the widthwise direction of said steel strip.

7. A continuous melt-plating apparatus comprising:

a plating melt bath;

a sink roller disposed in said plating melt of said plating melt bath for conveying a steel strip wound thereon and serving as a material to be plated;

gas wiping nozzles located above said plating melt bath and respectively disposed adjacent to a front surface and a rear surface of said steel strip so as to blow off and wipe off part of the plating melt attached to the front surface and rear surface of said steel strip guided from said plating melt bath for adjusting the plating thereon to a desired thickness thereof;

said sink roller having at least a part thereof immersed in the plating melt of said plating melt bath, and disposed on the opposite side of said steel strip form said sink roller, and adjustment means for selectively bending said guide roller in the widthwise direction thereof and/or inclining an axis of said guide roller in the horizontal direction thereof so as to be capable of pushing said steel strip with a force varied in the widthwise direction of said steel strip;

a detector for detecting displacement of said steel strip; and control means for calculating the bending and/or inclination force to be provided to said guide roller by said adjustment means which is needed to correct the displacement of said steel strip on the basis of a detection of said detector and for transmitting an operation signal to said adjustment means for providing said bending and/or inclination force.

8. A continuous melt-plating apparatus according to claim 7, wherein said sink roller comprises a plurality of sink roller elements supported by bearings disposed outside the plating melt within said plating melt bath.

* * * * *